United States Patent [19]

Claessens et al.

[11] 3,951,773

[45] Apr. 20, 1976

[54] FLUIDIZED BED ELECTRODE SYSTEM UTILIZING EMBEDDED INSULATOR AUXILIARY ELECTRODE

[75] Inventors: Pierre L. Claessens, Saint-Eustache; John L. Cromwell, Pincourt, both of Canada

[73] Assignee: Noranda Mines Limited, Toronto, Canada

[22] Filed: May 1, 1974

[21] Appl. No.: 466,086

[30] Foreign Application Priority Data

Aug. 13, 1973 Canada ..... 178684

[52] U.S. Cl. ..... 204/263; 204/275; 204/282; 204/290 R

[51] Int. Cl.[2] ..... C25B 11/02; C25B 13/02; C25B 13/04; C25B 15/08

[58] Field of Search ..... 204/282, 286, 280, 1 R, 204/284, 283, 290 R, 263; 161/89

[56] References Cited

UNITED STATES PATENTS

| | | | |
|---|---|---|---|
| 1,433,017 | 10/1922 | McKee | 204/282 |
| 1,864,490 | 6/1932 | Harrison et al. | 204/180 |
| 2,435,973 | 2/1948 | MacTaggart et al. | 204/282 |
| 3,457,152 | 7/1969 | Maloney, Jr. et al. | 204/131 |
| 3,497,443 | 2/1970 | Von Burgsdorff | 204/196 |
| 3,527,685 | 9/1970 | Anderson | 204/196 |
| 3,682,798 | 8/1972 | Tuddenham et al. | 204/108 |

*Primary Examiner*—T. Tung
*Assistant Examiner*—Aaron Weisstuch
*Attorney, Agent, or Firm*—Fleit & Jacobson

[57] ABSTRACT

An auxiliary electrode for direct introduction into a static-or fluidized bed main electrode comprises a conductive base material selected from the group consisting of lead or lead alloys, and a non conductive screen material preferably made of a synthetic, organic fiber screen cloth partially embedded into the conductive base material so as to insulate the auxiliary electrode from the static-or fluidized-bed main electrode.

4 Claims, 5 Drawing Figures

FLUIDIZED BED ELECTRODE SYSTEM UTILIZING EMBEDDED INSULATOR AUXILIARY ELECTRODE

This invention relates to an auxiliary electrode for use in electrolytic cells containing a fluidized bed or a static bed electrode composed of discrete metallic particles.

BACKGROUND OF THE INVENTION

The possibility and the advantage of using fluidized-bed electrodes in various electrochemical processes such as electrowinning of metals, or electrosynthesis of organic materials is increasingly recognized. The fluidized-bed electrode cells described in the literature present different configurations in regard to the geometry and location of anodes and cathodes, for example: side by side, concentric or plane parallel. Each of these configurations requires a minimum separation between the fluidized bed electrode and the auxiliary electrode to avoid short circuits between the oppositely charged electrodes. To achieve the separation, a porous membrane may be used as for example in the side by side and the concentric cells or by placing the auxiliary electrode at a sufficient distance above the fluidized-bed electrodes as in the plane parallel configuration. One major drawback found in these types of cells is the increased cell voltage created by either the distance between the auxiliary electrode and the main electrode or the diaphragm used to contain the fluidized-bed electrode and avoid short circuits.

The necessity for having the bed fluidized is governed by two factors: increasing the agitation so as to decrease appreciably the diffusion layer next to the electrode surface thus enabling high reaction rates, and avoiding agglomeration of the particles caused by welding through metal deposition in static parts of the bed. However, if the electrochemical reaction does not involve metal deposition but a partial reduction or oxidation of ionic species to different oxidation reduction states or, dissolution of metal composing the paricu-lated bed or, an organic electrochemical oxidation or reduction reaction at the surface of the particles resulting in gaseous or soluble products, the particles composing the bed need not be fluidized. The static bed could be comprised so as to be independent of the direction of flow of the electrolyte through the cell.

SUMMARY OF THE INVENTION

It is therefore the object of the present invention to provide a novel auxiliary electrode which will decrease the cell voltage and lower the consumption of power due to the potential drop in the solution between anode and cathode.

The auxiliary electrode, in accordance with the invention, comprises a conductive base material and a non conductive screen material preferably made of a synthetic, organic fiber screen cloth partially embedded into such conductive base material so as to insulate the auxiliary electrode from the static-or fluidized-bed main electrode. Such an auxiliary electrode may be directly introduced into the static-or fluidized-bed electrode.

The conductive base material is usually selected from the group consisting of lead and lead alloys.

The synthetic, organic fiber screen cloth is preferably selected from the group consisting of nylon, polyester, polyethylene, polypropylene and Teflon screen cloths.

The mesh opening of the screen material should not be more than about half the size of the static-or fluidized-bed particles so as to avoid any physical contacts between the particles and the auxiliary electrode.

The auxiliary electrode is preferably made in the form of sheets; it may further be worked to any reasonable shape by careful shaping so as to conform to the geometric requirements of the cell.

BRIEF DESCRIPTION OF THE DRAWINGS

The invention will now be disclosed with reference to a preferred embodiment thereof illustrated in the accompanying drawings in which.

DETAILED DESCRIPTION

Figure 1:
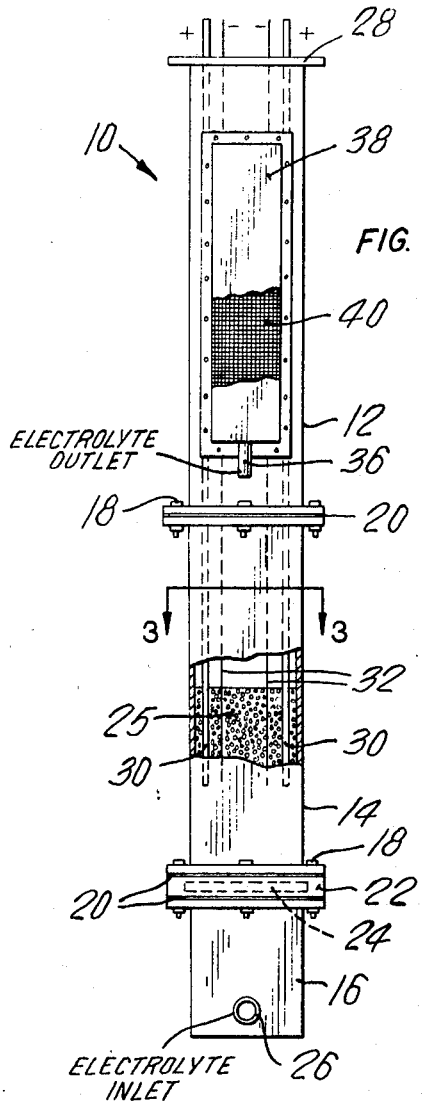
FIG. 1 illustrates a side view of a fluidized-bed electrode system wherein the auxiliary electrode is used.
Figure 2:
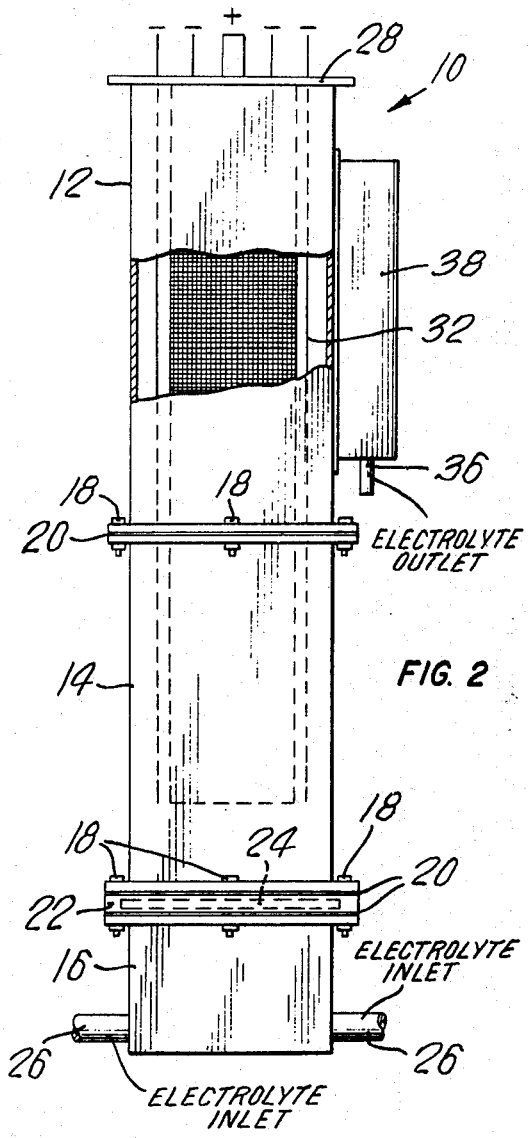
FIG. 2 illustrates another side view of the fluidized-bed electrode system of FIG. 1, also showing the auxiliary electrode in accordance with the invention.
Figure 3:
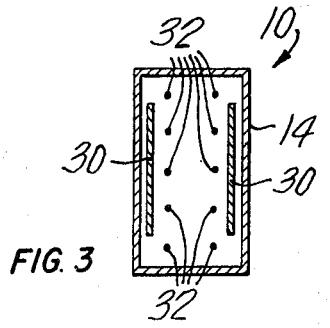
FIG. 3 illustrates a section taken along lines 3—3 of FIG. 1.

Referring to FIGS. 1–3, there is shown a typical fluidized-bed electrode system using an auxiliary electrode in accordance with the invention. The cell is composed of three housing sections 12, 14 and 16 secured together by any suitable means such as bolts 18 and sealed by gaskets 20. The housing may, of course, be made of a lower or even higher number of sections depending on the size of the cell and on the manufacturing facilities. The housing is normally made of an electrically non conductive material which is resistant to corrosion, or of metal coated with an electrically non conductive material for electrical insulation. A porous base support 22 is provided between sections 14 and 16 and such support is used to hold a porous plate 24 illustrated in dash lines and made of non conductive material such as polyethylene or polypropylene having a mesh size of not more than about half the size of the particles of the bed. The particulated bed 25 composing the fluidized electrode is supported by porous plate 24 and the particles of the bed may be made of metals or metal coated glass or plastic beads having a diameter ranging from 100 – 1000 microns depending upon the specific gravity of the particles. The housing is closed by a cover 28 which supports the auxiliary electrodes and the metallic current feeders 32 which are introduced into the fluidized bed electrode. The electrolyte solution to be treated is introduced into the cell through inlets 26 and flows out of the cell through outlets 36 located in the bottom of a small enclosure 38 communicating with the cell. In the embodiment disclosed, such solution is also used to fluidize the bed, however, separate fluidization of the bed may be done as disclosed in U.S. patent application Ser. No. 466,085 filed concurrently herewith. A screen 40 separates the cell from the enclosure 38 for retaining the particles of the bed in the cell. The mesh size of screen 40 should be less than the diameter of the particles of the bed.

In the embodiment of FIGS. 1 and 2, the auxiliary electrode 30 is connected to a source of positive potential whereas the feeders 32 are connected to a source of negative potential. The particles of the bed thus form the cathode of the electrolytic cell. If the particles of the bed were forming the anode of the cell, the polarities would obviously be reversed.

Figure 4:
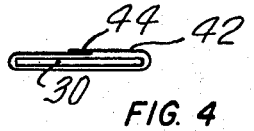
FIGS. 4 and 5 illustrate a method of making the auxiliary electrode in accordance with the invention.
Figure 5:
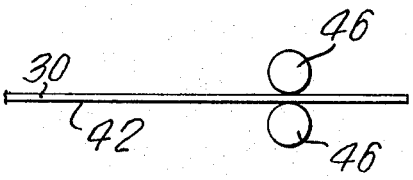

The auxiliary electrode 30 is in a sheet form and composed of a base material consisting of lead or lead alloys and of a non conductive screen material which is pressure inpregnated into the surface of the base material. The non conductive screen material may be a screen cloth of a synthetic, organic fiber material resistant to the electrolyte solution such as nylon, polyester, polyethylene, polypropylene or Teflon. Care must be taken during impregnation to control the pressure so that the screen cloth is only about 50% pressed into the lead, so as to prevent the particles of the bed from contacting the lead or lead alloy composition of the auxiliary electrode. Usually, a pressure of 2500 – 3500 psi is sufficient to achieve a proper impregnation with pure lead auxiliary electrodes. The mesh opening of the cloth depends on the size of the particles of the fluidized bed but should not preferably be more than about half the size of the particles of the fluidized bed. Referring to FIG. 4, it will be seen that the screen cloth 42 may be wound around the base material and glued or bonded at point 44. The auxiliary electrode is subsequently passed between two rollers 46 which are spaced a predetermined distance apart so as to provide the proper impregnation. The impregnated electrode prepared in sheet form may further be worked to any reasonable shape by careful shaping so as to conform to the geometric requirements of the cell.

It has been found that the above disclosed auxiliary electrode permits to lower the cell voltage and consequently the power consumption of the cell. For example, using the impregnated auxiliary electrode above disclosed during the copper electrowinning experiments from dilute solutions, power consumption of 1.2 – 1.6 kWhr/lb were measured, while using the same electrolyte solution but with conventional (bare) electrodes placed above the bed, the power consumption was 4.9 kWhr/lb.

Although the auxiliary electrode in accordance with the invention has been disclosed with reference to a fluidized-bed electrode system, it is to be understood that it may also be used with a static-bed electrode system when the particles of the bed need not be fluidized.

What is claimed is:

1. A static or fluidized bed electrode system comprising a. a chamber;

b. a main electrode of particulate material contained in said chamber; and c. an auxiliary electrode inserted into said particulate material and consisting of a conductive base material and a non conductive screen material partially embedded into said conductive base material so as to insulate the auxiliary electrode from the main electrode, said non conductive screen material having a mesh opening less than about half the size of the particles of the bed so as to avoid any physical contact between the particles and the auxiliary electrode.

2. An electrode system as defined in claim 1, wherein said non conductive screen material is a synthetic, organic fiber screen cloth.

3. An electrode system as defined in claim 2, wherein said synthetic organic fiber screen cloth is selected from the group consisting of nylon, polyester, polyethylene, polypropylene and polytetrafluoroethylene screen cloths.

4. An electrode system as defined in claim 1, wherein the auxiliary electrode is in the form of a sheet.

* * * * *